US009528060B2

(12) United States Patent
Takeshima et al.

(10) Patent No.: US 9,528,060 B2
(45) Date of Patent: Dec. 27, 2016

(54) SYSTEM OIL COMPOSITION FOR CROSSHEAD DIESEL ENGINE

(75) Inventors: Shigeki Takeshima, Chigasaki (JP); Naozumi Arimoto, Yokohama (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 68 days.

(21) Appl. No.: 14/347,423

(22) PCT Filed: Mar. 8, 2012

(86) PCT No.: PCT/JP2012/001613

§ 371 (c)(1),
(2), (4) Date: Jun. 2, 2014

(87) PCT Pub. No.: WO2013/046484

PCT Pub. Date: Apr. 4, 2013

(65) Prior Publication Data

US 2014/0373434 A1 Dec. 25, 2014

(30) Foreign Application Priority Data

Sep. 27, 2011 (JP) ..... 2011-211576

(51) Int. Cl.

| | |
|---|---|
| ***C10M 171/00*** | (2006.01) |
| ***C10M 171/02*** | (2006.01) |
| ***C10M 101/00*** | (2006.01) |
| ***C10L 1/26*** | (2006.01) |
| ***C10M 169/04*** | (2006.01) |
| ***C10L 1/04*** | (2006.01) |
| ***C10L 1/16*** | (2006.01) |
| ***C10L 10/00*** | (2006.01) |

(52) U.S. Cl.

CPC ..... *C10L 1/265* (2013.01); *C10L 1/04* (2013.01); *C10L 1/1625* (2013.01); *C10L 10/00* (2013.01); *C10M 169/048* (2013.01); *C10M 171/02* (2013.01); *C10M 2203/1025* (2013.01); *C10M 2205/024* (2013.01); *C10M 2205/026* (2013.01); *C10M 2205/028* (2013.01); *C10M 2205/0285* (2013.01); *C10M 2205/04* (2013.01); *C10M 2205/06* (2013.01); *C10M 2207/028* (2013.01); *C10M 2207/262* (2013.01); *C10M 2209/084* (2013.01); *C10M 2223/045* (2013.01); *C10M 2229/041* (2013.01); *C10N 2220/022* (2013.01); *C10N 2220/029* (2013.01); *C10N 2220/033* (2013.01); *C10N 2230/02* (2013.01); *C10N 2230/06* (2013.01); *C10N 2230/08* (2013.01); *C10N 2230/54* (2013.01); *C10N 2230/68* (2013.01); *C10N 2240/102* (2013.01)

(58) Field of Classification Search

CPC ..... C10L 1/265; C10L 1/04; C10L 1/1625; C10L 10/00; C10M 2203/1025; C10M 2207/028; C10M 2209/084; C10M 2223/045; C10M 2229/041; C10M 171/02; C10M 169/048; C10M 2205/024; C10M 2205/026; C10M 2205/0285; C10M 2205/06; C10M 2207/262; C10M 2205/028; C10M 2205/04; C10N 2220/022; C10N 2220/029; C10N 2220/033; C10N 2230/02; C10N 2230/06; C10N 2230/08; C10N 2230/54; C10N 2230/68; C10N 2240/102; C10N 2210/02

See application file for complete search history.

(56) References Cited

U.S. PATENT DOCUMENTS

| | | | | |
|---|---|---|---|---|
| 6,645,922 | B2 | 11/2003 | Dunn et al. | |
| 7,998,340 | B2 * | 8/2011 | Wedlock | C08K 5/01 208/19 |
| 8,383,562 | B2 | 2/2013 | Jukes | |
| 2007/0032392 | A1 | 2/2007 | Yokoyama et al. | |
| 2009/0203559 | A1 | 8/2009 | Bera et al. | |
| 2010/0099591 | A1 | 4/2010 | Harrold et al. | |
| 2011/0218131 | A1 * | 9/2011 | Tsujimoto | C10M 169/041 508/382 |
| 2012/0258898 | A1 * | 10/2012 | Takeshima | C10M 143/10 508/370 |

FOREIGN PATENT DOCUMENTS

| | | | |
|---|---|---|---|
| EP | 0 462 319 | A1 | 12/1991 |
| EP | 2 308 953 | A1 | 4/2011 |
| EP | 2 518 135 | A1 | 10/2012 |
| JP | H11-80771 | A | 3/1999 |

(Continued)

OTHER PUBLICATIONS http://www.widman.biz/English/Calculators/Mixtures.html http://www.widman.biz/Seleccion/mezcla.html (No Date available online 2015 and earlier).*

(No date—availabel online 2015 and earlier) http://www.widman.biz/English/Calculators/Mixtures.html http://www.widman.biz/Seleccion/mezcla.html.*

ASTM D445 (2015).*

ASTM D4583 (2013).*

Mar. 31, 2015 Office Action issued in Japanese Application No. 2013-535817.

Feb. 16, 2015 Office Action issued in Chinese Application No. 201280058099.X.

(Continued)

*Primary Examiner* — Pamela H Weiss

(74) *Attorney, Agent, or Firm* — Oliff PLC

(57) ABSTRACT

The present invention relates to a system oil composition for crosshead diesel engines, the system oil composition having excellent heat resistance and being effective for improvement of fuel efficiency. More specifically, the present invention relates to a system oil composition for crosshead diesel engines in which the system oil composition includes a mineral oil and/or a synthetic oil as a base oil (A) and has a kinematic viscosity of at least 35 $mm^2/s$ at 50° C., a high-shear viscosity of at most 45 mPa·s at 50° C., and a high-shear viscosity of at least 15 mPa·s at 70° C.

12 Claims, No Drawings

(56) References Cited

FOREIGN PATENT DOCUMENTS

| | | | | |
|---|---|---|---|---|
| JP | EP 0931827 | A1 * | 7/1999 | ..... C10M 169/048 |
| JP | A-2002-275491 | | 9/2002 | |
| JP | A-2004-300241 | | 10/2004 | |
| JP | A-2007-45850 | | 2/2007 | |
| JP | A-2007-231115 | | 9/2007 | |
| JP | A-2009-185293 | | 8/2009 | |
| JP | WO 2010041692 | A1 * | 4/2010 | ..... C10M 169/041 |
| JP | A-2010-523733 | | 7/2010 | |
| JP | 2010174092 | A * | 8/2010 | |
| JP | 2011-032406 | A | 2/2011 | |
| JP | A-2011-74387 | | 4/2011 | |
| JP | WO 2011077811 | A1 * | 6/2011 | ..... C10M 143/08 |
| JP | A-2011-219632 | | 11/2011 | |
| WO | WO 2011/077811 | A1 | 6/2011 | |

OTHER PUBLICATIONS

International Search Report issued in International Patent Application No. PCT/JP2012/001613 dated Jun. 12, 2012.

Written Opinion issued in International Patent Application No. PCT/JP2012/001613 dated Jun. 12, 2012 (with translation).

International Preliminary Report on Patentability issued in International Patent Application No. PCT/JP2012/001613 dated Apr. 1, 2014 (with translation).

May 19, 2015 Extended Search Report issued in European Application No. 12837042.6.

Nov. 6, 2015 Office Action issued in Chinese Application No. 201280058099.X.

May 13, 2016 Office Action Summary (Third) issued in Chinese Application No. 201280058099.X.

Aug. 31, 2016 Rejection Decision issued in Chinese Application No. 201280058099.X.

* cited by examiner

SYSTEM OIL COMPOSITION FOR CROSSHEAD DIESEL ENGINE

TECHNICAL FIELD

The present invention relates to a system oil composition for crosshead diesel engines.

BACKGROUND ART

Cylinder oil for lubricating between the cylinder and piston and system oil for lubricating and cooling other parts are used in crosshead diesel engines that are mainly used in large ships. The present invention relates to a system oil composition for crosshead diesel engines (hereinafter simply referred to as a system oil composition).

A system oil composition is used for lubrication of parts other than lubrication between the cylinder and piston (piston ring) in crosshead diesel engines. Examples of lubricated parts include the crankshaft and piston pin bearings, as well as cams and power take-off gears, and therefore sufficient viscosity, anti-wear, and anti-scuffing performance are required. Furthermore, the system oil composition is also used for cooling the backside of the piston combustion surface (called the undercrown), and therefore an extremely high oxidation stability and detergency are required.

In order to remove impurities, such as sludge resulting from deterioration of the lubricating oil, wear particles, water, and the like, system oil composition is normally purified with a centrifugal purifier or an oil purification device such as a variety of filters, strainers, or the like. In a centrifugal purifier, water is used as a medium, and therefore additive agents in the lubricating oil and water come into contact at a high temperature. Hydrolysis thus occurs easily, or sediments are easily formed due to the interaction of additive agents, making water tolerance necessary. Various efforts have thus been made in order to resolve these problems (see PTL 1 through 4).

CITATION LIST

Patent Literature

PTL 1: JP2007-231115A
PTL 2: JP2010-523733A
PTL 3: JP2002-275491A
PTL 4: JP2009-185293A

SUMMARY OF INVENTION

Technical Problem

Since a system oil composition is used in the above-described environment, a relatively high viscosity grade of approximately SAE 30 is used to keep a high lubricity in addition to the above properties. Therefore, a so-called multi grade oil, which is used as diesel engine oil for automobiles and includes a viscosity index improver, is not used as a system oil composition. In recent years, however, the escalating price of crude oil has raised the price of fuel oil, making greater effectiveness and improvement of fuel efficiency necessary for ship engines.

The present invention has been conceived in light of the above situation, and it is an object thereof to provide a system oil composition for crosshead diesel engines, the system oil composition having excellent thermal stability and being effective for improvement of fuel efficiency, and to provide a method for improving the efficiency of a crosshead diesel engine by using the system oil composition.

Solution to Problem

As a result of intensive study in order to achieve the above object, the inventors discovered that a system oil composition for crosshead diesel engines that includes a particular base oil composition and additive can contribute to achieving the above object, thereby completing the present invention.

Namely, a system oil composition for crosshead diesel engines according to the present invention includes a mineral oil and/or a synthetic oil as a base oil (A) and has a kinematic viscosity of at least 35 $mm^2/s$ at 50° C., a high-shear viscosity of at most 45 mPa·s at 50° C., and a high-shear viscosity of at least 15 mPa·s at 70° C.

In a first aspect of the system oil composition for crosshead diesel engines, the base oil (A) is preferably a mixture of a base oil having a kinematic viscosity of at least 3 $mm^2/s$ and at most 9 $mm^2/s$ at 100° C. and a base oil having a kinematic viscosity of greater than 9 $mm^2/s$ and at most 15 $mm^2/s$ at 100° C.

In a second aspect of the system oil composition for crosshead diesel engines, the base oil (A) is preferably a mixture of a base oil having a kinematic viscosity of greater than 15 $mm^2/s$ and at most 30 $mm^2/s$ at 100° C. and a base oil having a kinematic viscosity of greater than 3 $mm^2/s$ and at most 12 $mm^2/s$ at 100° C., a fraction of a total base oil amount occupied by the base oil having the kinematic viscosity of greater than 15 $mm^2/s$ and at most 30 $mm^2/s$ at 100° C. is preferably at least 7% by mass, and a viscosity index improver (B) with a PSSI of at most 30 is preferably included.

In a second aspect of the system oil composition for crosshead diesel engines according to the present invention, the viscosity index improver (B) is preferably at least one selected from an olefin polymer, a star polymer having in a molecule thereof a vinyl aromatic hydrocarbon structure, and a methyl methacrylate polymer.

The system oil composition for crosshead diesel engines according to the present invention preferably further includes a metallic detergent (C) and a phosphorus compound (D).

A method according to the present invention for improving efficiency of crosshead diesel engines uses the above system oil composition for crosshead diesel engines.

Advantageous Effect of Invention

The system oil composition for crosshead diesel engines according to the present invention is suitable for use not only as system oil (crankcase oil) in two-stroke crosshead engines for ships, but also as engine oil (crankcase oil) in four-cycle medium speed trunk piston engines for ships and for cogeneration of electric power.

DESCRIPTION OF EMBODIMENTS

The following describes the present invention in detail. The base oil in the system oil composition for crosshead diesel engines according to the present invention is not particularly limited, and a mineral base oil and/or a synthetic base oil normally used in lubricating oil may be used.

Examples of a mineral base oil include an oil manufactured by applying one or more of solvent deasphalting, solvent extraction, hydrocracking, solvent dewaxing, hydrorefining, and the like to lubricating oil distillate yielded by reduced-pressure distillation of atmospheric residue obtained through atmospheric distillation of crude oil, as well as wax isomerized mineral oil, lubricant base oil manufactured by a method for isomerization of GTL WAX (gas-to-liquid wax) manufactured by a process such as a Fischer-Tropsch process, and the like.

The total aromatic content of the mineral base oil is not particularly limited yet is preferably at most 40% by mass and more preferably at most 30% by mass. The total aromatic content of the mineral base oil may be 0% by mass, yet from the perspective of solubility of additives, the total aromatic content is preferably at least 1% by mass, more preferably at least 5% by mass, even more preferably at least 10% by mass, and still more preferably at least 20% by mass. A total aromatic content of the base oil exceeding 40% is not preferable, since the oxidative stability worsens.

Note that the above "total aromatic content" indicates the aromatic fraction content measured in conformity with ASTM D2549. Normally, in addition to alkyl benzene and alkyl naphthalene, the aromatic fraction includes anthracene, phenanthrene, an alkylation of the above, a compound in which four or more benzene rings are condensed, heteroaromatic compounds such as pyridines, quinolines, phenols, or naphthols, and the like.

The sulfur content in the mineral base oil is not particularly limited, yet is preferably at most 1% by mass and more preferably at most 0.7% by mass. The sulfur content in the mineral base oil may be 0% by mass, yet is preferably at least 0.1% by mass and more preferably at least 0.2% by mass. Including a certain degree of sulfur content in the mineral base oil can greatly improve the solubility of additives.

Examples of the synthetic base oil include polybutene or hydrogenated compounds thereof; poly-α-olefins such as 1-octene oligomer and 1-decene oligomer or hydrogenated compounds thereof; diesters such as ditridecyl glutarate, di-2-ethyl hexyl adipate, diisodecyl adipate, ditridecyl adipate, and di-2-ethyl hexyl sebacate; polyol esters such as trimethylol propane caprylate, trimethylol propane pelargonate, pentaerythritol-2-ethyl hexanoate, and pentaerythritol pelargonate; copolymers of a dicarboxylic acid such as dibutyl maleate and an α-olefin with a carbon number of 2 to 30; aromatic synthetic oils such as alkyl naphthalene, alkyl benzene, and aromatic esters, or mixtures thereof; and the like.

A mineral base oil, a synthetic base oil, any mixture of two or more base oils selected from mineral base oils and synthetic base oils, or the like may be used as the base oil in the present invention. Examples include one or more mineral base oils, one or more synthetic base oils, a mixture of one or more mineral base oils and one or more synthetic base oils, and the like.

The kinematic viscosity of the base oil that is used is not particularly limited, yet at 100° C., the kinematic viscosity is preferably from 3 $mm^2/s$ to 40 $mm^2/s$, more preferably from 6 $mm^2/s$ to 20 $mm^2/s$, and even more preferably from 7 $mm^2/s$ to 12 $mm^2/s$. If the kinematic viscosity of the base oil at 100° C. exceeds 40 $mm^2/s$, the low temperature viscosity characteristics worsen, whereas if the kinematic viscosity is less than 3 $mm^2/s$, oil film formation is insufficient at the lubrication spot, causing lubricity to deteriorate and loss of base oil by evaporation to increase, both of which are undesirable. Note that the kinematic viscosity at 100° C. referred to above indicates the kinematic viscosity at 100° C. as specified by ASTM D-445.

The viscosity index of the base oil that is used is not particularly limited, yet in order to obtain excellent viscosity characteristics from a low temperature to a high temperature, the value thereof is preferably at least 80, more preferably at least 90, and even more preferably at least 95. No particular restriction is placed on the upper limit of the viscosity index of the base oil, and a base oil with a viscosity index of approximately 135 to 180 may be used, such as normal paraffin, slack wax, GTL wax, or the like, or an isoparaffinic mineral oil in which these are isomerized. A complex ester base oil or HVI-PAO base oil with a viscosity index of approximately 150 to 250 may also be used. From the perspective of solubility and storage stability of additives, however, the viscosity index is preferably at most 120 and more preferably at most 110.

The system oil composition for crosshead diesel engines according to the present invention has a kinematic viscosity of at least 35 $mm^2/s$ at 50° C., a high-shear viscosity of at most 45 mPa·s at 50° C., and a high-shear viscosity of at least 15 mPa·s at 70° C.

The kinematic viscosity at 50° C. is preferably at least 40 $mm^2/s$, more preferably at least 42 $mm^2/s$, preferably at most 150 $mm^2/s$, more preferably at most 80 $mm^2/s$, and even more preferably at most 60 $mm^2/s$. The high-shear viscosity at 50° C. is preferably at most 43 mPa·s, more preferably at most 40 mPa·s, and preferably at least 25 mPa·s. The high-shear viscosity at 70° C. is preferably at least 15.5 mPa·s, more preferably at least 16.0 mPa·s, preferably at most 35 mPa·s, more preferably at most 25 mPa·s, and even more preferably at most 20 mPa·s.

Note that if the kinematic viscosity of the system oil composition at 50° C. is less than 35 $mm^2/s$, the oil pressure of the system oil supply system may not reach a predetermined pressure, leading to insufficient supply of system oil and the risk of burning. On the other hand, if the kinematic viscosity of the system oil composition at 50° C. exceeds 150 $mm^2/s$, the oil pump efficiency worsens.

Furthermore, if the high-shear viscosity of the system oil composition at 50° C. exceeds 45 mPa·s, the effect of improving the efficiency of the crosshead diesel engine cannot be achieved. On the other hand, if the high-shear viscosity of the system oil composition at 50° C. is lower than 25 mPa·s, oil film formation properties by the bearings may be insufficient, leading to the risk of burning.

If the high-shear viscosity of the system oil composition at 70° C. is less than 15 mPa·s, oil film formation properties by the turbocharger may be insufficient, leading to the risk of scuffing. Conversely, a value of at most 25 mPa·s for the high-shear viscosity of the system oil composition at 70° C. heightens the effect of improving the efficiency of the crosshead diesel engine. If the high-shear viscosity at 70° C. exceeds 35 mPa·s, the efficiency of the tuebocharger worsens.

Note that in the present invention, the high-shear viscosity is measured at the prescribed temperatures at a shear velocity of $10^6$ $s^{-1}$ in conformity with the measurement method prescribed by ASTM D4683.

In the first aspect of the present invention, the system oil composition has a mineral oil and/or a synthetic oil as a base oil (A) and has a kinematic viscosity of at least 35 $mm^2/s$ at 50° C., a high-shear viscosity of at most 45 mPa·s at 50° C., and a high-shear viscosity of at least 15 mPa·s at 70° C., and furthermore the base oil (A) is preferably a mixture of a base oil having a kinematic viscosity of at least 3 $mm^2/s$ and at most 9 $mm^2/s$ at 100° C. and a base oil having a kinematic viscosity of greater than 9 $mm^2/s$ and at most 15 $mm^2/s$ at 100° C.

The base oil having a kinematic viscosity of at least 3 $mm^2/s$ and at most 9 $mm^2/s$ at 100° C. preferably has a kinematic viscosity of at least 4 $mm^2/s$ and at most 8 $mm^2/s$ at 100° C. Furthermore, the base oil having a kinematic viscosity of greater than 9 $mm^2/s$ and at most 15 $mm^2/s$ at 100° C. preferably has a kinematic viscosity of at least 9.5 $mm^2/s$ and at most 12 $mm^2/s$ at 100° C. and more preferably at least 10 $mm^2/s$ and at most 11 $mm^2/s$.

If the kinematic viscosity is less than 3 $mm^2/s$ at 100° C., the vaporizability is high, and both lubricity and cooling efficiency are insufficient. On the other hand, if the kinematic viscosity exceeds 15 $mm^2/s$ at 100° C., it becomes difficult to keep the high-shear viscosity to a value of at most 45 mPa·s at 50° C., preventing the effect of improving the efficiency of the crosshead diesel engine from being obtained sufficiently.

By using a mixture of a base oil having a kinematic viscosity of at least 3 $mm^2/s$ and at most 9 $mm^2/s$ at 100° C. (low kinematic viscosity base oil) and a base oil having a kinematic viscosity of greater than 9 $mm^2/s$ and at most 15 $mm^2/s$ at 100° C. (high kinematic viscosity base oil), the molecular weight distribution of the base oil increases, and the viscosity index increases above that of a base oil with a narrow molecular weight distribution, thereby maintaining a high-shear viscosity of at least 15 mPa·s at 70° C. while yielding a lower high-shear viscosity at 50° C. As a result, a greater effect of improving the efficiency of the crosshead diesel engine can be obtained. Note that from the perspective of suppressing vaporizability, the mass ratio of the low kinematic viscosity base oil to the high kinematic viscosity base oil (low kinematic viscosity base oil/high kinematic viscosity base oil) is preferably in a range of 5/95 to 40/60.

The second aspect of the present invention has a mineral oil and/or a synthetic oil as a base oil (A) and has a kinematic viscosity of at least 35 $mm^2/s$ at 50° C., a high-shear viscosity of at most 45 mPa·s at 50° C., and a high-shear viscosity of at least 15 mPa·s at 70° C. Furthermore, the base oil (A) is preferably a mixture of a base oil having a kinematic viscosity of greater than 15 $mm^2/s$ and at most 30 $mm^2/s$ at 100° C. and a base oil having a kinematic viscosity of greater than 3 $mm^2/s$ and at most 12 $mm^2/s$ at 100° C., the fraction of the total base oil amount occupied by the base oil having the kinematic viscosity of greater than 15 $mm^2/s$ and at most 30 $mm^2/s$ at 100° C. is preferably at least 7% by mass, and a viscosity index improver (B) with a PSSI of at most 30 is preferably included.

The base oil having the kinematic viscosity of greater than 3 $mm^2/s$ and at most 12 $mm^2/s$ at 100° C. preferably has a kinematic viscosity of greater than 3 $mm^2/s$ and at most 9 $mm^2/s$ at 100° C., even more preferably from 4 $mm^2/s$ to 8 $mm^2/s$, and still more preferably from 6 $mm^2/s$ to 8 $mm^2/s$. If the kinematic viscosity is at most 3 $mm^2/s$ at 100° C., the vaporizability is high, and both lubricity and cooling properties are insufficient. On the other hand, if the kinematic viscosity exceeds 12 $mm^2/s$ at 100° C., the effect of improving the efficiency of the crosshead diesel engine cannot be obtained sufficiently.

The fraction of the total mixed base oil occupied by the base oil having the kinematic viscosity of greater than 15 $mm^2/s$ and at most 30 $mm^2/s$ at 100° C. is at least 7% by mass and preferably at least 10% by mass. At a value of less than 7% by mass, the cleanliness worsens, and at a value exceeding 40% by mass, the oxidative stability worsens.

Examples of the viscosity index improver include so-called non-dispersion type viscosity index improvers containing polymers or copolymers, or hydrogen additives thereof, of a single type, or two or more types, of a monomer selected from methacrylate esters; so-called dispersion type viscosity index improvers in which methacrylate esters further including a nitrogen compound are copolymerized; non-dispersion type or dispersion type ethylene-α-olefin copolymers (examples of α-olefin include propylene, 1-butene, 1-pentene, and the like) or hydrogenated products thereof, polyisobutylenes or hydrogen additives thereof, styrene-diene hydrogenated copolymers, styrene-maleic anhydride ester copolymers, and polyalkyl styrenes.

The molecular weight of these viscosity index improvers needs to be selected taking shear stability into consideration. Specifically, the weight-average molecular weight of the viscosity index improvers is, for example, normally 10,000 to 300,000, and preferably 50,000 to 200,000, in the case of dispersion type and non-dispersion type polymethacrylates; normally 10,000 to 300,000, and preferably 50,000 to 200,000, in the case of dispersion type and non-dispersion type olefin copolymers; and normally 100,000 to 700,000, and preferably 250,000 to 500,000, in the case of star polymers.

The PSSI (permanent shear stability index) of the viscosity index improver according to the present invention is preferably at most 30, more preferably at most 20, even more preferably at most 10, still more preferably at most 8, and most preferably at most 6. If the PSSI exceeds 30, the power take-off gear may shear, causing the viscosity to lower, and a decrease in oil film formation ability may lead to burning.

Note that the term "PSSI" used herein denotes the Permanent Shear Stability Index of a polymer calculated based on data measured by ASTM D 6278-02 (Test Method for Shear Stability of Polymer Containing Fluids Using a European Diesel Injector Apparatus) in conformity with ASTM D 6022-01 (Standard Practice for Calculation of Permanent Shear Stability Index).

In the present invention, among the viscosity index improvers, non-dispersion type or dispersion type ethylene-α-olefin copolymers that are polymers of olefin monomers (examples of α-olefin include propylene, 1-butene, 1-pentene, and the like) or hydrogenated products thereof, polyisobutylenes or hydrogen additives thereof, styrene-diene hydrogenated copolymers, polyalkyl styrenes, and the like are preferable. Among these, star polymers or ethylene-α-olefin copolymers, or hydrogenated products thereof, formed from styrene-diene copolymers and hydrogenated products thereof are more preferable. In particular, star polymers are preferable, since their use allows for a system oil composition with particularly excellent shear stability. A single type, or two or more types, of a compound selected freely from the above viscosity index improvers may be included in any amount.

Based on a normal system oil composition, the content of the viscosity index improver is from 1.0% to 15.0% by mass, preferably from 1.5% to 10.0% by mass, and more preferably from 2.0% to 8.0% by mass. When the content of the viscosity index improver is less than 1.0% by mass, the effect of increasing viscosity is insufficient, whereas when the content exceeds 15.0% by mass, the shear stability and the cleanliness of the system oil composition may worsen.

The system oil composition for crosshead diesel engines according to the present invention preferably further includes a metallic detergent (C) and a phosphorus compound (D).

The metallic detergent is not particularly limited, and examples include well-known alkali metal or alkali earth metal sulfonate detergents, alkali metal or alkali earth metal phenate detergents, alkali metal or alkali earth metal salicylate detergents, alkali metal or alkali earth metal naphthenate detergents, alkali metal or alkali earth metal phosphonate detergents, a mixture of two or more of these (including a complex type), and the like.

Examples of the above alkali metals include sodium, potassium, and the like. Examples of alkali earth metals include calcium, magnesium, and barium. Alkali earth metals are preferred, with calcium or magnesium being particularly preferable. Note that the total base number and the additive amount of these metallic detergents may be selected freely in accordance with the required performance of the system oil.

Not only neutral metallic detergents but also (overbased) basic metallic detergents are included in the above metallic detergents, and in the present invention, an (overbased) basic metallic detergent including calcium carbonate and/or calcium borate is preferable.

In the present invention, from the perspective of cleanliness and water separability, phenate, salicylate, or a mixture thereof is preferable as the metallic detergent. In particular, salicylate can reduce friction and is therefore the most preferable.

While the base number of the metallic detergent is not particularly limited, normally a value of at least 20 mg KOH/g is preferable, at least 100 mg KOH/g being more preferable, and at least 150 mg KOH/g being particularly preferable. Normally, a value of at most 500 mg KOH/g is preferable, at most 350 mg KOH/g being more preferable, and at most 300 mg KOH/g being particularly preferable. Note that the base number as used herein denotes the base number measured by a perchloric acid method in conformity with section 7 of JIS K2501, "Petroleum products and lubricants—Determination of neutralization number" (the same applying hereafter).

While the content of the metallic detergent is not particularly limited in the present invention, in terms of total content of the composition, the content is normally 1% to 30% by mass, preferably 2% to 20% by mass, and more preferably 2.5% to 10% by mass. The content in terms of metal content is preferably 0.12% to 1.0% by mass, more preferably 0.15% to 0.7% by mass, and even more preferably 0.17% to 0.5% by mass. When the content in terms of metal content of the metallic detergent is less than 0.1% by mass, improvement of the fatigue life and extreme pressure performance is insufficient, whereas upon exceeding 4.0% by mass, water resistance diminishes, and hence neither range is preferable.

In order to improve the wear prevention characteristics of the system oil composition according to the present invention, the phosphorus compound (D) is preferably added.

Examples of the phosphorus compound include zinc dialkyldithiophosphate, phosphorous acid esters, thiophosphorous acid esters, dithiophosphorous acid esters, trithiophosphorous acid esters, phosphoric acid esters, thiophosphoric acid esters, dithiophosphoric acid esters, trithiophosphoric acid esters, amine salts thereof, metallic salts thereof, derivatives thereof, and the like.

As the phosphorus compound in the present invention, zinc dialkyldithiophosphate is preferable. An example of zinc alkyldithiophosphate is represented by the following general formula (1).

[Chem. 1]

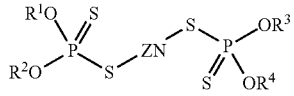

(1)

In the general formula (1), $R^1$, $R^2$, $R^3$, and $R^4$ each individually represent a hydrocarbon group having 1 to 24 carbon atoms. Each hydrocarbon group having 1 to 24 carbon atoms is preferably a straight-chain or branched alkyl group having 1 to 24 carbon atoms. The hydrocarbon groups preferably have a carbon number of at least 3 and preferably have a carbon number of at most 12, more preferably at most 8. The alkyl groups may be primary, secondary or tertiary, yet primary alkyl groups, secondary alkyl groups, and a mixture thereof are preferable, with secondary alkyl groups being most preferable.

In the present invention, a phosphorus compound not including sulfur may be used. Examples include phosphorous acid; phosphorous acid monoesters having one of the above hydrocarbon groups with a carbon number of 1 to 30; phosphorous acid diesters having two of the above hydrocarbon groups with a carbon number of 1 to 30; phosphorous acid triesters having three of the above hydrocarbon groups with a carbon number of 1 to 30; a mixture thereof; and metallic salts thereof. Note that phosphonic acid ester, which is a tautomer of phosphorous acid monoesters and phosphorous acid diesters, is also included in these compounds.

These phosphorus compounds may also be mixed and used without any problem.

In the system oil composition according to the present invention, the content of the phosphorus compound in terms of total content of the composition is, as elemental phosphorus, normally 0.001% to 0.3% by mass, preferably 0.01% to 0.2% by mass, and more preferably 0.03% to 0.1% by mass. If the content of the component (D) by elemental phosphorus is less than 0.001% by mass, the wear prevention characteristics tend to be insufficient, whereas a content exceeding 0.3% by mass does not yield an effect commensurate with the additive amount and also may deteriorate, leading to deposits.

In order to further improve the characteristics of the system oil composition of the present invention, and in accordance with other objectives, any additives generally used in a lubricating oil may be added. Examples of such additives include ashless dispersants, antioxidants, antiwear agents or extreme pressure agents other than the above-described phosphorus compounds, friction modifiers, viscosity index improvers, corrosion inhibitors, rust inhibitors, demulsifiers, metal deactivators, anti-foaming agents, coloring agents, and the like.

Any ashless dispersant used in lubricating oil may be used as the ashless dispersant. Examples include a nitrogen-containing compound or a derivative thereof having in the molecule at least one straight-chain or branched alkyl group or alkenyl group with a carbon number of 40 to 400. Examples of the nitrogen-containing compound referred to above include succinimides, benzylamines, polyamines, Mannich bases, and the like. Examples of derivatives thereof include derivatives in which boron compounds such as boric acid, borate, and the like, phosphorus compounds such as (thio)phosphoric acid, (thio)phosphate, and the like, organic acids, and hydroxy(poly)oxyalkylene carbonate or the like act on these nitrogen-containing compounds. In the present invention, any single type, or two or more types, selected from the above compounds may be blended.

In the present invention, the content when blending an ashless dispersant is not particularly limited, yet in terms of total content of the composition, the content is normally 0% to 5% by mass, preferably 0.2% to 3% by mass, and more preferably 0.5% to 2% by mass. When the content of the ashless dispersant is less than the above ranges, the rate of sulfuric acid neutralization tends to be insufficient, and the effect of cleanliness is also insufficient. Upon exceeding the above ranges, not only is an effect commensurate with the additive amount not achieved, but also water resistance is greatly reduced.

Examples of the antioxidant include phenol-based or amine-based ashless antioxidants or metallic antioxidants. Among these, amine-based antioxidants are preferable from the perspective of maintaining high-temperature cleanliness. In terms of total content of the composition, the content of the antioxidant is normally 0.1% to 5% by mass, and preferably 0.5% to 2% by mass.

As the antiwear agent (or extreme pressure agents) other than phosphorus compounds, any antiwear agent used in lubricating oil may be used. For example, sulfur, phosphorous, and sulfur-phosphorous extreme pressure agents may be used. Examples include phosphorous acid esters, thiophosphorous acid esters, dithiophosphorous acid esters, trithiophosphorous acid esters, phosphoric acid esters, thiophosphoric acid esters, dithiophosphoric acid esters, trithiophosphoric acid esters, amine salts thereof, metallic salts thereof, derivatives thereof, dithiocarbamate, disulfides, polysulfides, sulfurized olefins, sulfurized fats and oils, and the like. When these antiwear agents (or extreme pressure agents) are used in the lubricating oil composition according to the present invention, their content is not particularly limited, yet in terms of total content of the composition, the content is normally 0.01% to 5% by mass.

Examples of the friction modifier include ashless friction modifiers such as fatty acid esters, aliphatic amines, fatty acid amides, and the like; and metallic friction modifiers such as molybdenum dithiocarbamates and molybdenum dithiophosphates. In terms of total content of the composition, the content of the friction modifier is normally 0.01% to 5% by mass.

Examples of the corrosion inhibitor include benzotriazole-based, tolyltriazole-based, thiadiazole-based, and imidazole-based compounds.

Examples of the rust inhibitor include petroleum sulfonates, alkyl benzene sulfonates, dinonylnaphthalene sulfonates, alkenyl succinic acid esters, and polyhydric alcohol esters.

Examples of the demulsifier include polyalkylene glycol-based non-ionic surfactants such as polyoxyethylene alkyl ethers, polyoxyethylene alkyl phenyl ethers, and polyoxyethylene alkyl naphthyl ethers.

Examples of the metal deactivator include imidazolines, pyrimidine derivatives, alkyl thiadiazoles, mercaptobenzothiazoles, benzotriazoles and derivatives thereof, 1,3,4-thiadiazole polysulfide, 1,3,4-thiadiazolyl-2,5-bisdialkyl dithiocarbamate, 2-(alkyldithio) benzoimidazole, and β-(o-carboxybenzylthio) propionitrile.

Examples of the anti-foaming agent include silicone oil, alkenylsuccinic acid derivatives, esters of polyhydroxy aliphatic alcohols and long-chain fatty acids, methylsalicylate, o-hydroxybenzyl alcohol, aluminum stearate, potassium oleate, N-dialkyl-allylamine nitroaminoalkanol, aromatic amine salts of isoamyloctyl phosphate, alkylalkylene diphosphates, metal derivatives of thioethers, metal derivatives of disulfides, fluorine compounds of aliphatic hydrocarbons, triethylsilane, dichlorosilane, alkylphenyl polyethylene glycol ether sulfide, and fluoroalkyl ethers.

When these additives are included in the system oil composition of the present invention, the corrosion inhibitor, rust inhibitor, and demulsifier are each selected within a range of normally 0.005% to 5% by mass, the metal deactivator within a range of normally 0.005% to 1% by mass, and the anti-foaming agent within a range of normally 0.0005% to 1% by mass, in terms of total content of the composition.

EXAMPLES

The present invention will be described in more detail with reference to the following Examples and Comparative Examples, yet the present invention is not limited thereto.

Examples 1 to 5

Comparative Examples 1 to 5

A fuel consumption test was conducted using a two-stroke crosshead engine with a three-cylinder turbocharger (3UEC37LA engine). The specifications are listed below, and the results are listed in Table 1.

Cylinder inner diameter: 370 mm
Piston stroke: 880 mm
Output: 1105 kW
Frequency of rotation: 188 rpm
Fuel: fuel oil A (sulfur content 0.08% to 0.09% by mass)
Cylinder oil: base number 40 mg KOH/g, SAE 50

In Table 1, the fuel consumption improvement rate is indicated as an improvement rate over commercial system oil (base number 5.3 mg KOH/g, SAE 30). A positive value indicates that fuel consumption improved (lessened) as compared to commercial system oil, whereas a negative value indicates that fuel consumption worsened (increased) as compared to commercial system oil. Note that the ratio of frictional loss with respect to fuel consumption is 6.5%.

TABLE 1

| | | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|---|
| Base oil | | | | | | | | | | |
| base oil 1 | mass % *1 | 55 | 51 | 55 | 57 | 55 | 55 | 55 | 23 | — |
| base oil 2 | mass % *1 | — | — | — | — | — | — | — | — | — |
| base oil 3 | mass % *1 | 30 | 39 | 30 | 28 | 30 | 30 | 30 | 77 | — |
| base oil 4 | mass % *1 | 15 | 10 | 15 | 15 | 15 | 15 | 15 | — | — |
| base oil 5 | mass % *1 | — | — | — | — | — | — | — | — | 25 |

TABLE 1-continued

| | | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|---|
| base oil 6 | mass % *1 | — | — | — | — | — | — | — | — | 75 |
| base oil 7 | mass % *1 | — | — | — | — | — | — | — | — | — |
| Additives | | | | | | | | | | |
| metallic detergent 1 (Ca content in composition) | mass % *2 | 2.75 (0.254) | 2.75 (0.254) | 2.00 (0.182) | 3.92 (0.357) | 2.75 (0.254) | — | 2.75 (0.254) | 2.75 (0.254) | 2.75 (0.254) |
| metallic detergent 2 (Ca content in composition) | mass % *2 | — | — | — | — | — | 4.10 (0.255) | — | — | — |
| zinc dialkyldithiophosphate (P content in composition) | mass % 2* | 0.55 (0.04) | 0.55 (0.04) | 0.55 (0.04) | 0.55 (0.04) | 0.55 (0.04) | 0.55 (0.04) | 0.55 (0.04) | 0.55 (0.04) | 0.55 (0.04) |
| viscosity index improver 1 | mass % *2 | 4.7 | 4.7 | 4.7 | 4.7 | — | 4.7 | — | — | — |
| viscosity index improver 2 | mass % *2 | — | — | — | — | 4.5 | — | — | — | — |
| viscosity index improver 3 | mass % *2 | — | — | — | — | — | — | 4.5 | — | — |
| pour point depressant | mass % *2 | 0.03 | 0.03 | 0.03 | 0.03 | 0.03 | 0.03 | 0.03 | 0.03 | 0.03 |
| anti-foaming agent | mass % *3 | 0.002 | 0.002 | 0.002 | 0.002 | 0.002 | 0.002 | 0.002 | 0.002 | 0.002 |
| Kinematic viscosity of base oil (100° C.) | $mm^2/s$ | 7.1 | 7.1 | 7.1 | 7.1 | 7.1 | 7.1 | 7.1 | 8.6 | 8.9 |
| Base number of composition (perchloric acid method) | mg KOH/g | 7.0 | 7.0 | 5.1 | 10.0 | 7.0 | 7.0 | 7.0 | 7.0 | 7.0 |
| Kinematic viscosity of composition | | | | | | | | | | |
| (40° C.) | $mm^2/s$ | 82.16 | 81.33 | 81.55 | 82.60 | 76.53 | 82.16 | 66.25 | 71.40 | 69.70 |
| (100° C.) | $mm^2/s$ | 11.54 | 11.56 | 11.51 | 11.58 | 10.67 | 11.52 | 11.09 | 9.03 | 9.30 |
| Viscosity index of composition | | 132 | 134 | 132 | 132 | 126 | 131 | 134 | 100 | 110 |
| High-shear viscosity of composition | | | | | | | | | | |
| (50° C.) | mPa · s | 31.1 | 31.0 | 30.9 | 31.1 | 30.1 | 30.7 | 30.5 | 37.0 | 39.2 |
| (70° C.) | mPa · s | 16.7 | 16.8 | 16.5 | 16.7 | 16.0 | 16.7 | 16.2 | 18.5 | 18.0 |
| Kinematic viscosity (50° C.) | $mm^2/s$ | 53.3 | 53.0 | 53.3 | 53.6 | 49.5 | 52.6 | 48.8 | 44.9 | 44.5 |
| Fuel consumption improvement rate (vs. commercial system oil) | | 0.84 | 0.87 | 0.84 | 0.81 | 0.88 | 0.85 | 0.86 | 0.65 | 0.63 |
| Shear stability | | | | | | | | | | |
| viscosity after shearing (100° C.) | $mm^2/s$ | 11.46 | 11.45 | 11.41 | 11.48 | 9.94 | 11.43 | 10.91 | 9.02 | 9.29 |
| Panel coking test | | | | | | | | | | |
| weight of deposit | mg | 52 | 57 | 58 | 52 | 49 | 46 | 49 | 39 | 41 |

TABLE 2

| | | Comp. Ex. 1 | Comp. Ex. 2 | Comp. Ex. 3 | Comp. Ex. 4 | Comp. Ex. 5 | Ref. Ex. |
|---|---|---|---|---|---|---|---|
| Base oil | | | | | | | |
| base oil 1 | mass % *1 | — | — | 85 | — | 100 | Commercial system oil |
| base oil 2 | mass % *1 | — | — | 15 | — | — | |
| base oil 3 | mass % *1 | 67 | — | — | 50 | — | |
| base oil 4 | mass % *1 | 33 | 15 | — | 20 | — | |
| base oil 5 | mass % *1 | — | — | — | 30 | — | |
| base oil 6 | mass % *1 | — | — | — | — | — | |
| base oil 7 | mass % *1 | — | 85 | — | — | — | |
| Additives | | | | | | | |
| metallic detergent 1 (Ca content in composition) | mass % *2 | 2.75 (0.254) | 2.75 (0.254) | 2.75 (0.254) | 2.75 (0.254) | 2.75 (0.254) | |
| metallic detergent 2 (Ca content in composition) | mass % *2 | — | — | — | — | — | |
| zinc dialkyldithiophosphate | mass % *2 | 0.55 | 0.55 | 0.55 | 0.55 | 0.55 | |

TABLE 2-continued

| | | Comp. Ex. 1 | Comp. Ex. 2 | Comp. Ex. 3 | Comp. Ex. 4 | Comp. Ex. 5 | Ref. Ex. |
|---|---|---|---|---|---|---|---|
| (P content in composition) | | (0.04) | (0.04) | (0.04) | (0.04) | (0.04) | |
| viscosity index improver 1 | mass % *2 | — | — | — | — | 9 | |
| viscosity index improver 2 | mass % *2 | — | — | — | — | — | |
| viscosity index improver 3 | mass % *2 | — | — | — | — | — | |
| pour point depressant | mass % *2 | 0.03 | 0.03 | 0.03 | 0.03 | 0.03 | |
| anti-foaming agent | mass % *3 | 0.002 | 0.002 | 0.002 | 0.002 | 0.002 | |
| Kinematic viscosity of base oil (100° C.) | $mm^2/s$ | 14.8 | 11.5 | 4.7 | 10.9 | 4.4 | |
| Base number of composition (perchloric acid method) | mg KOH/g | 7.0 | 7.0 | 7.0 | 7.0 | 7.0 | 5.3 |
| Kinematic viscosity of composition | | | | | | | |
| (40° C.) | $mm^2/s$ | 149.7 | 85.00 | 54.40 | 88.50 | 65.19 | 103.3 |
| (100° C.) | $mm^2/s$ | 14.91 | 11.50 | 7.55 | 11.00 | 11.18 | 11.63 |
| Viscosity index of composition | | 99 | 125 | 100 | 110 | 165 | 100 |
| High-shear viscosity of composition | | | | | | | |
| (50° C.) | mPa · s | 79.2 | 46.5 | 32.7 | 49.3 | 18.9 | 57.6 |
| (70° C.) | mPa · s | 32.5 | 21.5 | 14.9 | 22.1 | 11.8 | 24.7 |
| Kinematic viscosity (50° C.) | $mm^2/s$ | 89.4 | 54.7 | 34.9 | 55.6 | 44.5 | 64.0 |
| Fuel consumption improvement rate (vs. commercial system oil) | | −0.57 | 0.19 | loss of oil pressure control | 0.13 | — | 0.00 (ref) |
| Shear stability | | | | | | | |
| viscosity after shearing (100° C.) | $mm^2/s$ | 14.89 | 11.49 | 7.53 | 10.8 | 9.65 | 11.62 |
| Panel coking test | | | | | | | |
| weight of deposit | mg | 33 | 47 | 50 | 30 | 178 | 44 |

*1: Content by percentage in base oil

*2: Content in terms of total content of the composition (in mass %)

*3: Represented as an additional mass % with the total content of the composition being 100% by mass (out mass %)

Base oil 1: solvent-refined base oil, kinematic viscosity at 100° C.=4.42 $mm^2/s$, viscosity index=102

Base oil 2: solvent-refined base oil, kinematic viscosity at 100° C.=7.12 $mm^2/s$, viscosity index=96

Base oil 3: solvent-refined base oil, kinematic viscosity at 100° C.=10.8 $mm^2/s$, viscosity index=97

Base oil 4: solvent-refined base oil, kinematic viscosity at 100° C.=31.7 $mm^2/s$, viscosity index=96

Base oil 5: hydrogenation-refined base oil, kinematic viscosity at 100° C.=6.40 $mm^2/s$, viscosity index=130

Base oil 6: solvent-refined base oil, kinematic viscosity at 100° C.=10.3 $mm^2/s$, viscosity index=106

Base oil 7: poly-α-olefin, kinematic viscosity at 100° C.=10 $mm^2/s$, viscosity index=137

Metallic detergent 1: overbased calcium phenate, base number=255 mg KOH/g, Ca content=9.25% by mass, metal ratio=3.7

Metallic detergent 2: overbased calcium salicylate, base number=170 mg KOH/g, Ca content=6.2% by mass, metal ratio=2.3

Zinc dialkyldithiophosphate: primary zinc dialkyldithiophosphate (alkyl=2-ethyl hexyl), P content=7.4% by mass Viscosity index improver 1: polyisoprene star polymer, PSSI=2, Mw=400,000

Viscosity index improver 2: olefin copolymer, PSSI=24, Mw=100,000

Viscosity index improver 3: dispersion type PMA, PSSI=5, Mw=102,000

Pour point depressant: PMA, n-C12-C22

Anti-foaming agent: dimethyl polysiloxane, kinematic viscosity at 100° C.=3,000 $mm^2/s$ High-shear viscosity: shear velocity of $10^6$ $s^{-1}$ For the system oil compositions in the examples, fuel consumption improved (lessened) by 0.63% to 0.88%, with friction decreasing by 9.7% to 13.5%.

Conversely, with the system oil composition of Comparative Example 1, which has a higher viscosity than commercial system oil, fuel consumption was worse than that of commercial system oil.

The system oil composition of Comparative Examples 2 and 4, in which the high-shear viscosity at 50° C. exceeded 45 mPa·s, did not exhibit a significant improvement in fuel consumption.

For the system oil composition of Comparative Example 3, in which the kinematic viscosity at 50° C. is less than 35 $mm^2/s$, a fuel consumption test could not be conducted since the oil pressure did not reach a predetermined pressure and was uncontrollable.

For the system oil composition of Comparative Example 5, in which the high-shear viscosity at 70° C. was less than 15.0 mPa·s, no fuel consumption test was conducted since damage to the turbocharger was expected.

The invention claimed is:

1. A system oil composition for a crosshead diesel engine, comprising a mineral base oil having a total aromatic content of 10% to 40% by mass as a base oil (A) and having a kinematic viscosity as specified by ASTM D-445 of at least 35 $mm^2/s$ at 50° C., a high-shear viscosity measured at 50° C. in conformity with the measurement method prescribed by ASTM D4683 of at most 45 mPa·s, and a high-shear viscosity measured at 70° C. in conformity with the measurement method prescribed by ASTM D4683 of at least 15 mPa·s.

2. The system oil composition for a crosshead diesel engine according to claim 1, wherein the base oil (A) is a mixture of a base oil having a kinematic viscosity of greater than 15 $mm^2/s$ and at most 30 $mm^2/s$ at 100° C. and a base oil having a kinematic viscosity of greater than 3 $mm^2/s$ and at most 12 $mm^2/s$ at 100° C., and a fraction of a total base oil amount occupied by the base oil having the kinematic viscosity of greater than 15 $mm^2/s$ and at most 30 $mm^2/s$ at 100° C. is at least 7% by mass, and further comprising a viscosity index improver (B) with a PSSI of at most 30.

3. The system oil composition for a crosshead diesel engine according to claim 2, wherein the viscosity index improver (B) is at least one selected from an olefin polymer, a star polymer having in a molecule thereof a vinyl aromatic hydrocarbon structure, and a methyl methacrylate polymer.

4. The system oil composition for a crosshead diesel engine according to claim 1, further comprising a metallic detergent (C) and a phosphorus compound (D).

5. A method for improving efficiency of a crosshead diesel engine using the system oil composition for a crosshead diesel engine according to claim 1.

6. The system oil composition for a crosshead diesel engine according to claim 2, further comprising a metallic detergent (C) and a phosphorus compound (D).

7. The system oil composition for a crosshead diesel engine according to claim 3, further comprising a metallic detergent (C) and a phosphorus compound (D).

8. A method for improving efficiency of a crosshead diesel engine using the system oil composition for a crosshead diesel engine according to claim 2.

9. A method for improving efficiency of a crosshead diesel engine using the system oil composition for a crosshead diesel engine according to claim 3.

10. A method for improving efficiency of a crosshead diesel engine using the system oil composition for a crosshead diesel engine according to claim 4.

11. A method for improving efficiency of a crosshead diesel engine using the system oil composition for a crosshead diesel engine according to claim 6.

12. A method for improving efficiency of a crosshead diesel engine using the system oil composition for a crosshead diesel engine according to claim 7.

* * * * *